US010549411B2

(12) United States Patent
Berman

(10) Patent No.: US 10,549,411 B2
(45) Date of Patent: Feb. 4, 2020

(54) UNIVERSAL TOOLS

(71) Applicant: Alexander Berman, Gladwyne, PA (US)

(72) Inventor: Alexander Berman, Gladwyne, PA (US)

( * ) Notice: Subject to any disclaimer, the term of this patent is extended or adjusted under 35 U.S.C. 154(b) by 0 days.

(21) Appl. No.: 15/442,700

(22) Filed: Feb. 26, 2017

(65) Prior Publication Data

US 2017/0266789 A1 Sep. 21, 2017

Related U.S. Application Data

(60) Provisional application No. 62/302,024, filed on Mar. 1, 2016, provisional application No. 62/461,206, filed on Feb. 20, 2017.

(51) Int. Cl.

| | |
|---|---|
| ***B25B 13/10*** | (2006.01) |
| ***B25B 23/12*** | (2006.01) |
| ***B25B 23/00*** | (2006.01) |
| ***B25B 7/02*** | (2006.01) |
| ***B25B 15/00*** | (2006.01) |

(Continued)

(52) U.S. Cl.

CPC ..... *B25B 23/0035* (2013.01); *B25B 7/02* (2013.01); *B25B 7/08* (2013.01); *B25B 13/105* (2013.01); *B25B 15/004* (2013.01); *B25B 15/005* (2013.01); *B25B 15/007* (2013.01); *B25B 15/008* (2013.01); *B25B 21/007* (2013.01); *B25B 23/12* (2013.01)

(58) Field of Classification Search

CPC ..... B25B 23/0035; B25B 7/02; B25B 7/08; B25B 23/12; B25B 21/007; B25B 15/005; B25B 15/007; B25B 15/008; B25B 15/004; B25B 13/105; B25G 1/102

USPC ..... 81/442, 185, 71, 179, DIG. 11, 448; 269/266

See application file for complete search history.

(56) References Cited

U.S. PATENT DOCUMENTS 3,674,070 A * 7/1972 Mahoney ..... B25B 13/105 81/185
3,698,267 A * 10/1972 Denney ..... B25B 13/105 269/266
5,287,778 A 2/1994 Cook (Continued)

FOREIGN PATENT DOCUMENTS

WO WO 2016207709 A1 * 12/2016 ..... B25B 13/105

OTHER PUBLICATIONS

PCT/US2017/020292 (counterpart to this application), international search report and opinion, dated Jun. 7, 2017.

*Primary Examiner* — Monica S Carter
*Assistant Examiner* — Makena S Markman
(74) *Attorney, Agent, or Firm* — Muskin and Farmer LLC

(57) ABSTRACT

A universal tool which can be a screwdriver, wrench, pliers, or any other tool. The tool can operate on an object (e.g., a screw, bolt, etc.) of any shape because of a set of pins that can mold to match a shape of the object. For example, a same universal screwdriver has pegs which mold themselves to match a shape of a slotted screw head or mold themselves to match a shape of a philips screw head. A user of the universal screwdriver can then turn such screw by turning the universal screwdriver in a standard fashion. When the universal screwdriver is removed from the object, then the pegs automatically revert themselves to a default position so a different shaped screw head can then be operated on.

18 Claims, 14 Drawing Sheets

(51) Int. Cl.
*B25B 21/00* (2006.01)
*B25B 7/08* (2006.01)

(56) References Cited

U.S. PATENT DOCUMENTS

| | | | | |
|---|---|---|---|---|
| 5,460,064 | A * | 10/1995 | Zayat, Jr. | B25B 13/105 81/185 |
| 6,374,710 | B2 * | 4/2002 | Kuo | B25B 13/105 81/185 |
| 7,886,637 | B2 * | 2/2011 | Campbell | B25B 13/105 29/700 |
| 8,770,069 | B2 | 7/2014 | Draizin | |
| 2006/0175773 | A1 * | 8/2006 | Tsai | B25B 15/001 279/143 |
| 2013/0263706 | A1 * | 10/2013 | Safar | B25B 15/004 81/448 |

* cited by examiner

FIG. 11
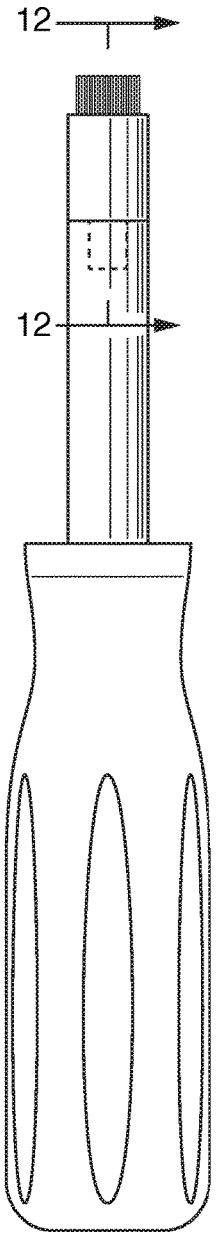
FIG. 12
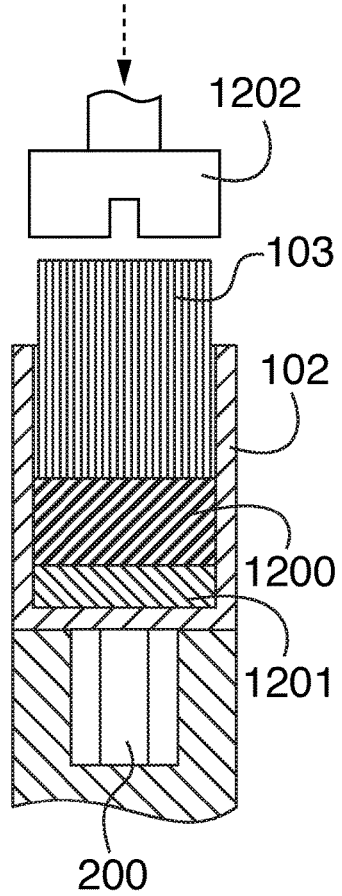
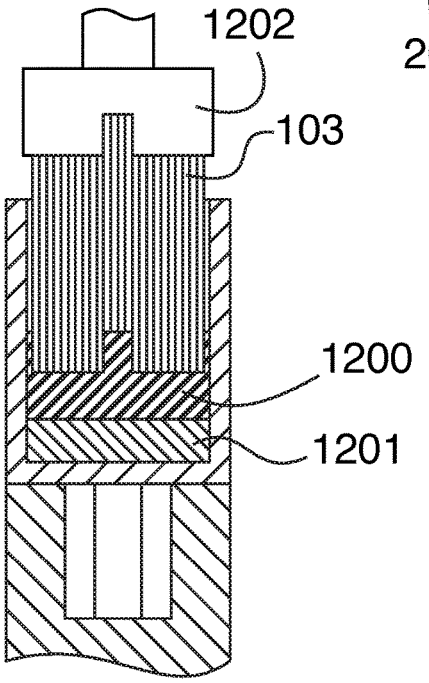
FIG. 13A

FIG. 19B
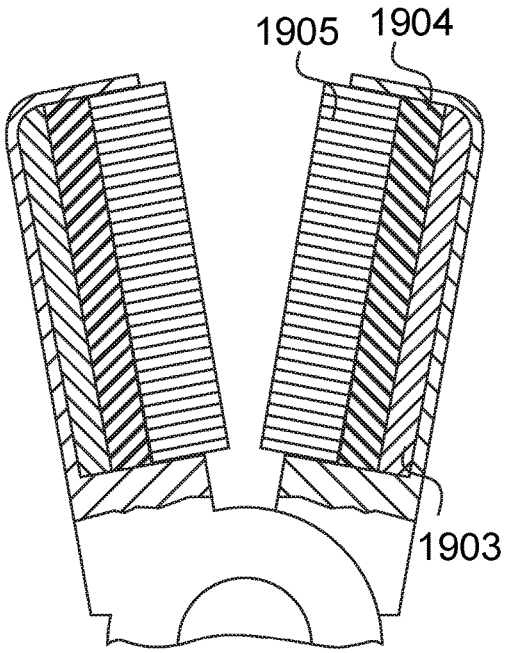
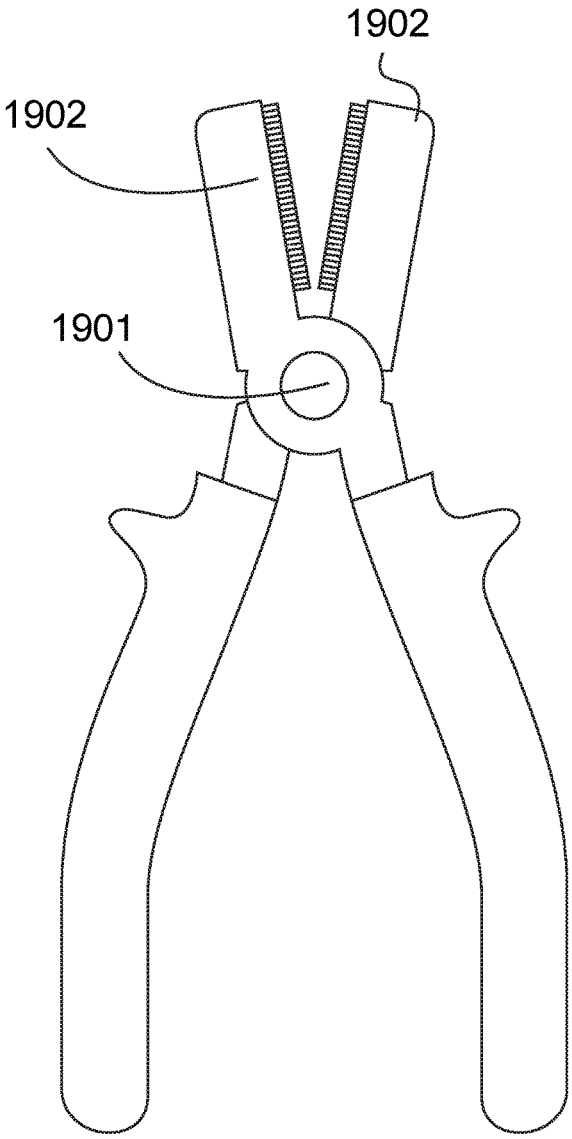
FIG. 19A

UNIVERSAL TOOLS

CROSS REFERENCE TO RELATED APPLICATIONS

This application claims benefit to U.S. provisional application 62/302,024, which is incorporated by reference herein in its entirety. This application also claims benefit to U.S. provisional application 62/461,206, which is incorporated by reference herein in its entirety.

BACKGROUND OF THE INVENTION

Field of the Invention

The present general inventive concept is directed to a method and apparatus directed to a tool which can adapt to operate on a variety of objects.

Description of the Related Art

A tool (e.g., a screwdriver) is generally particular to particular objects (e.g., a screw). For example, screws have different heads, such as a slotted, philips, square, etc. A different screwdriver could be used to fit each different type of head.

One prior art method to enable a single tool (e.g., screwdriver) to adapt to different types of heads enables different bits to fit into the tool. Thus, a number of different bits can come with the screwdriver and the user can insert the particular bit that matches the head of the object the user wishes to turn.

This solution has a number of drawbacks. The user still needs to have a bit that matches the head the user wishes to turn. The user also has to manually swap out the bit presently inside the screwdriver for the new bit.

Mahoney U.S. Pat. No. 3,674,070 and Cook U.S. Pat. No. 5,287,778 describe universal screwdrivers which can adapt to different types of heads, however, these disclosures contain numerous drawbacks.

What is needed is a re-usable tool which can easily adapt to operate on different objects and has an improved operation over the prior art.

SUMMARY OF THE INVENTION

It is an aspect of the present invention to provide an improved tool.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 11 is a drawing illustrating a top view of a universal screwdriver, according to an embodiment;

FIG. 12 is a drawing illustrating a cross section looking in the direction of the slice marked '12' illustrated in FIG. 11 with the pegs not inserted into a screw, according to an embodiment;

FIG. 13A is a drawing illustrating a cross section looking in the direction of the slice marked '12' illustrated in FIG. 11 with the pegs inserted into the screw, according to an embodiment;

FIG. 19A is a drawing illustrating a top view of a universal pliers, according to an embodiment;

FIG. 19B is a cross section of the casing of the pliers shown in FIG. 19A, according to an embodiment;

DESCRIPTION OF THE PREFERRED EMBODIMENTS

Figure 1A:
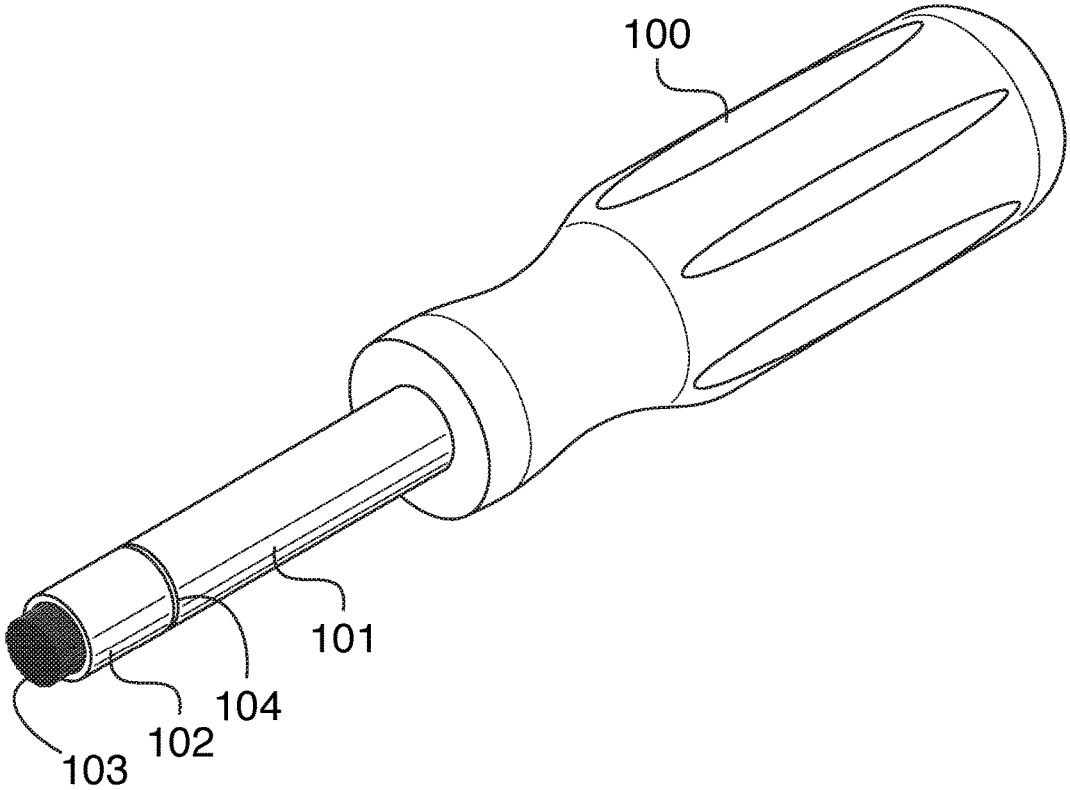
FIG. 1A is a drawing illustrating an orthographic view of a universal screwdriver, according to an embodiment.

Reference will now be made in detail to the presently preferred embodiments of the invention, examples of which are illustrated in the accompanying drawings, wherein like reference numerals refer to like elements throughout.

The present inventive concept relates to a plurality of different tools (e.g., screwdriver, wrench, pliers, etc.) which have a "universal" character in that it can automatically change shape to operate on a variety of differently shaped objects. A casing houses a set of pegs which can move forward and backward so that the pegs can fit (when manual force is applied to the screwdriver in the direction of the screw ("external force")) into a head of the screw (or other object such as a bolt, etc.) The screwdriver can then be turned which then turns the screw.

FIG. 1A is a drawing illustrating an orthographic view of a universal screwdriver, according to an embodiment.

A body 100 is attached to a shaft 101 which attached to a casing 102 which houses pegs 103. The user operates the universal screwdriver by pressing the pegs onto the head of the screw to be turned, and then turning the screwdriver as known in the art. The pegs 103 will move to fit into the head of the screw to be turned. A groove 104 exists between the shaft 101 and the casing 102 where they both connect.

Figure 1B:
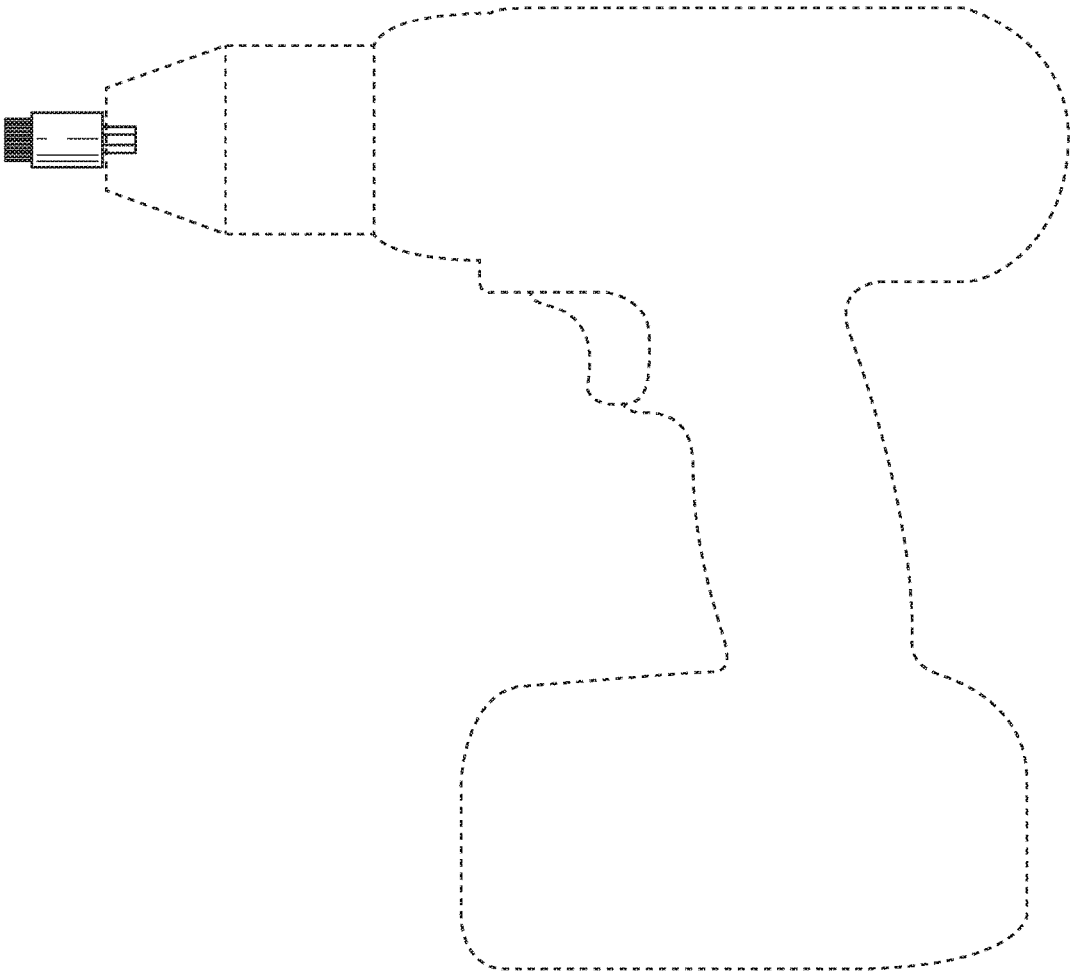
FIG. 1B is a drawing illustrating an orthographic view of a casing inserted into a drill, according to an embodiment.

FIG. 1B is a drawing illustrating an orthographic view of a casing inserted into a drill, according to an embodiment. The same casing (including pegs and other associated structure as described herein) can also be used with a drill (the operation of the pegs and casing operate in the same manner as in the screwdriver embodiment) in order to enable a drill to operate on a variety of different shaped objects. The drill can be electrical (e.g., battery powered or plugged in).

Figure 2:
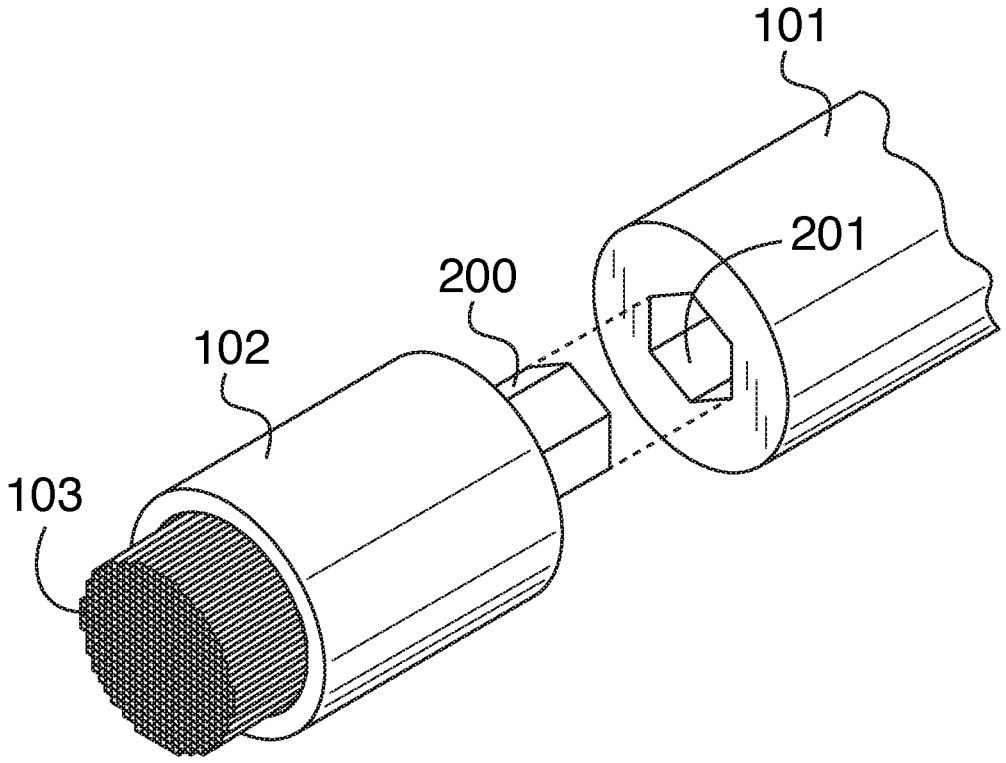
FIG. 2 is a drawing illustrating an orthographic view of how a casing fits into a body of the screwdriver, according to an embodiment.

FIG. 2 is a drawing illustrating an orthographic view of how a casing fits into a body of the screwdriver, according to an embodiment.

The casing 102 houses the pegs 103. A male hex connector 200 at an end of the casing 102 fits into a female hex connector 201 inside the shaft 101. The casing 102 can be easily removed from the body shaft 101 and easily reinserted.

Note that while a hex connector is illustrated in FIG. 2, any other type of connecting mechanism can be used as well (e.g., the shaft can be internally threaded and the casing outside on its end can also be threaded to cooperatively screw into the internally threaded shaft, etc.)

Figure 3A:
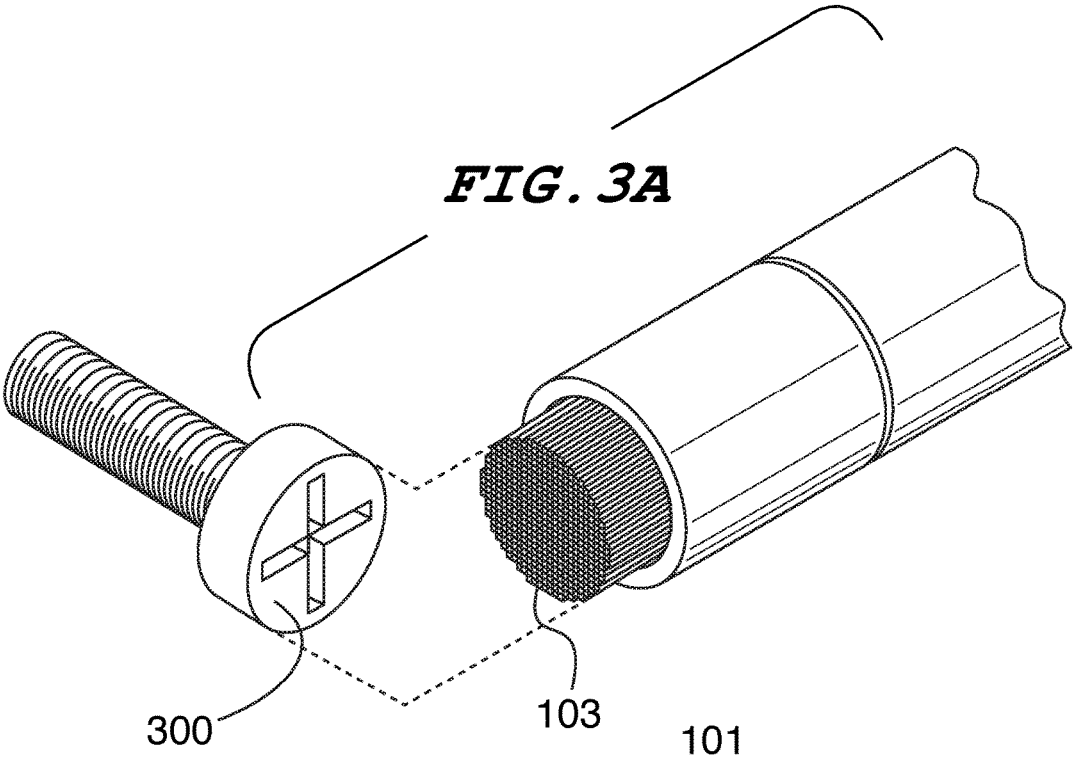
FIG. 3A is a drawing illustrating an orthographic view of a set of pegs in the casing and a screw with a philips head, according to an embodiment.

FIG. 3A is a drawing illustrating an orthographic view of a set of pegs in the casing and a screw with a philips head, according to an embodiment.

The pegs 103 will naturally extend outward when no pressure is applied to them. A screw with a philips screw head 300 is the object to be operated on by the screwdriver.

Figure 3B:
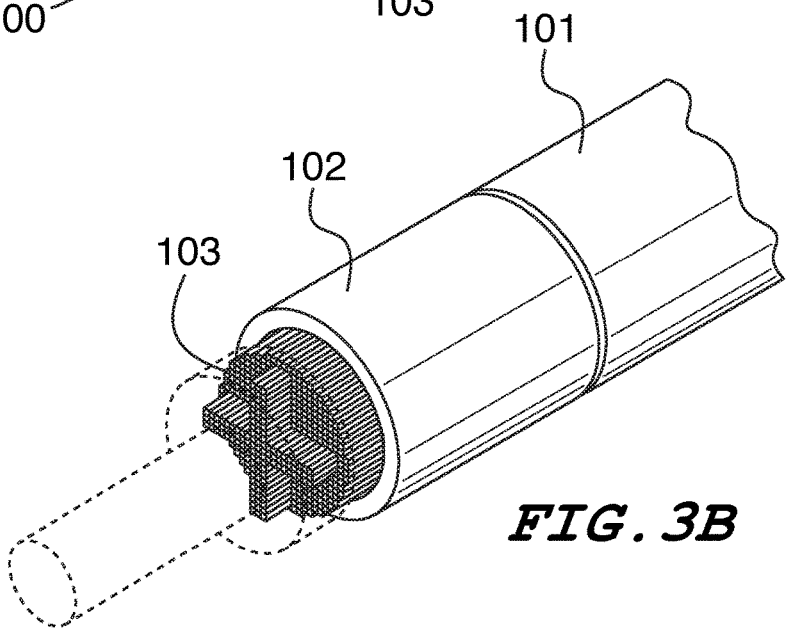
FIG. 3B is a drawing illustrating an orthographic view of a set of pegs after being pushed into the philips head, according to an embodiment.

FIG. 3B is a drawing illustrating an orthographic view of a set of pegs after being pushed into the philips head, according to an embodiment.

When pressure (directed in the direction of the screw) is applied to the screwdriver, it causes some pegs to be pushed into the casing 102 as illustrated in FIG. 4. Note the philips pattern of the pegs which is caused by pressure being applied to the philips head. All of the recessed area in the head will be filled in by the pegs thereby ideally causing little or no empty space inside the recessed area. It may be possible that some peg(s) may remain in their natural state while some peg(s) are pushed down, the peg(s) being in their natural state fitting completely into a part (e.g., recess) of the object (e.g., screw head) without pressure from the screw head pushing the respective peg(s) down.

Figure 4A:
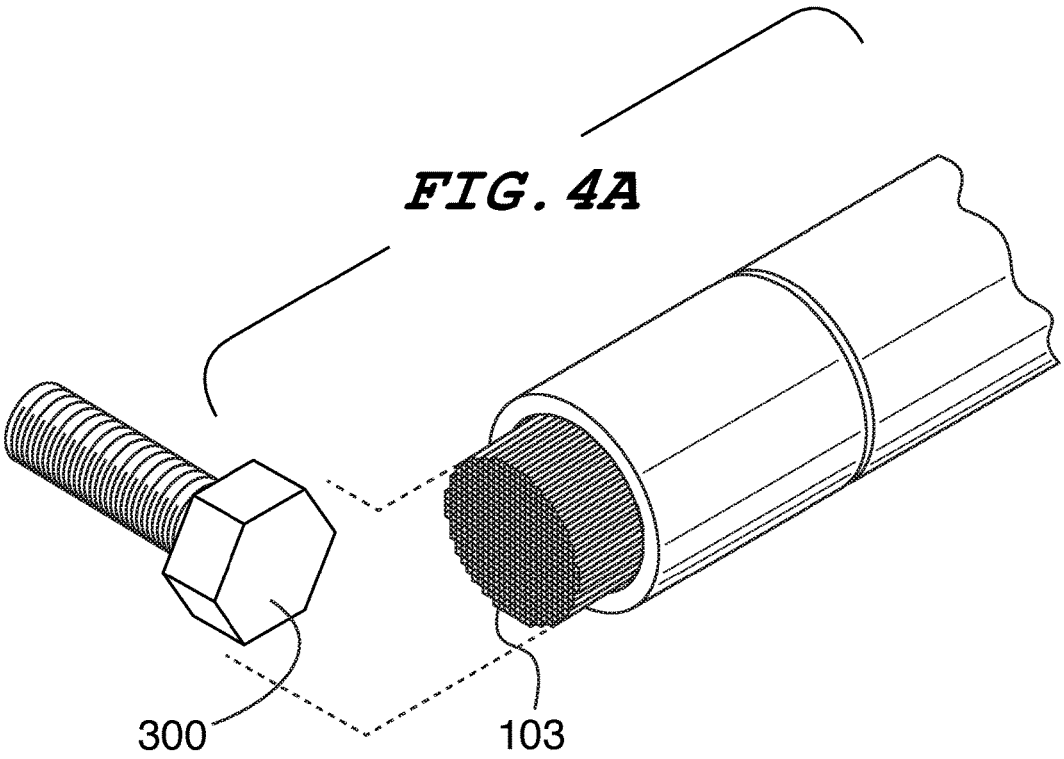
FIG. 4A is a drawing illustrating an orthographic view of a set of pegs in the casing and a bolt, according to an embodiment.
Figure 4B:
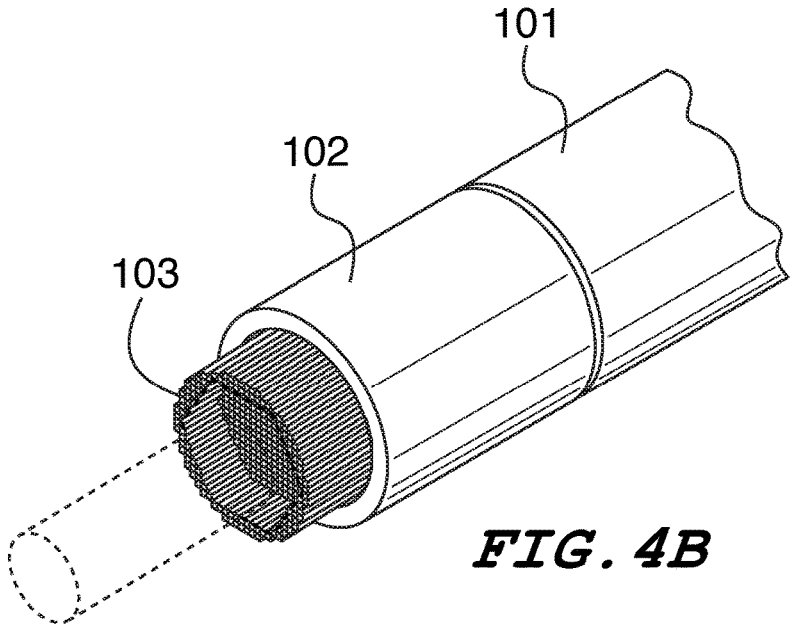
FIG. 4B is a drawing illustrating an orthographic view of a set of pegs after being pushed into the bolt, according to an embodiment.

FIG. 4A is a drawing illustrating an orthographic view of a set of pegs in the casing and a bolt, according to an embodiment. FIG. 4B is a drawing illustrating an orthographic view of a set of pegs after being pushed into the bolt, according to an embodiment. FIGS. 4A and 4B operate the same as described with respect to FIGS. 3A and 3B but note that the object being operated on is a bolt which has no internal recess.

Figure 5:
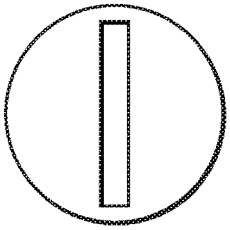
FIG. 5 is a drawing illustrating a top view of a screw having a slotted head, according to an embodiment.

FIG. 5 is a drawing illustrating a top view of a screw having a slotted head, according to an embodiment.

Figure 6:
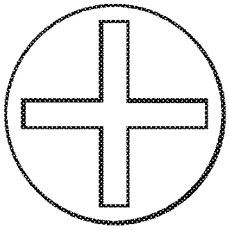
FIG. 6 is a drawing illustrating a top view of a screw having a philips head, according to an embodiment.

FIG. 6 is a drawing illustrating a top view of a screw having a philips head, according to an embodiment.

Figure 7:
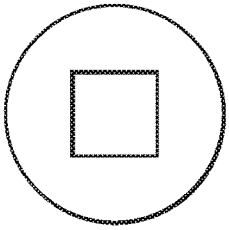
FIG. 7 is a drawing illustrating a top view of a screw having a square head, according to an embodiment.

FIG. 7 is a drawing illustrating a top view of a screw having a square head, according to an embodiment.

Figure 8:
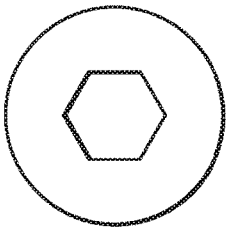
FIG. 8 is a drawing illustrating a top view of a screw having an allen head, according to an embodiment.

FIG. 8 is a drawing illustrating a top view of a screw having an allen head, according to an embodiment.

Figure 9:
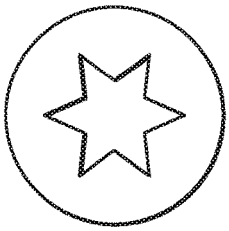
FIG. 9 is a drawing illustrating a top view of a screw having a torx head, according to an embodiment.

FIG. 9 is a drawing illustrating a top view of a screw having a torx head, according to an embodiment.

Figure 10:
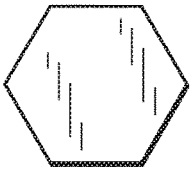
FIG. 10 is a drawing illustrating a top view of a hex bolt, according to an embodiment.

FIG. 10 is a drawing illustrating a top view of a hex bolt, according to an embodiment. Note that the universal screwdriver can be used to turn a bolt head as illustrated which does not contain a recessed area. Note that to turn a bolt, the surface area of an outside end of the pegs (which would contact the bold) has to be larger than the head of the bolt itself.

Note that FIGS. 5-10 illustrate some examples of shapes of screw heads that can be operated on by the universal tool, but these are merely examples of some shapes and there is no limit or restriction on the shapes that can be operated on by the universal tool.

FIG. 11 is a drawing illustrating a top view of a universal screwdriver, according to an embodiment.

FIG. 12 is a drawing illustrating a cross section looking in the direction of the slice marked '12' illustrated in FIG. 11 with the pegs not inserted into a screw, according to an embodiment. No pressure is being applied to the screw by the screwdriver, and thus the pegs are in their natural (default) state.

The casing 102 houses the pegs 103, elastic material 1200, and at least one magnet 1201. The casing 102 is hollow with a recessed area which contains the pegs 103, the elastic material 1200, and the magnet 1201. The casing 102 can be made of any hard material, such as steel, aluminum, hard plastic (e.g., PLA), etc. Also shown is a screw head 1202 which has not made contact with the pegs 103 in FIG. 12.

The pegs 103 can be arranged in any shape, such as circular, rectangular (not square), square, etc. Any sized array of pegs can be used, for example in a square shape the number of pegs can be 8 by 8, 10 by 10, 12 by 12, or any other such dimensions. Generally speaking, the more pegs the better as the smaller the pegs are the tighter the fit that can be achieved between the pegs and the head of the screw. The pegs themselves can be any shape, such as cylinders, cuboid, etc. Each peg out of the pegs should be independently movable so as to accommodate any shape of screw head that they are pressed into. The pegs 103 would typically not stick out a long amount outside of the casing. The pegs 103 can be made out of any material, such as steel (or any other metal), hard plastic, etc. The pegs can extrude outside of the casing any length (a long length or a short length), depending on the embodiment. The pegs can also recede inside the casing any length (a long length or a short length), depending on the embodiment. Furthermore, the pegs should recede a larger length on the inside of the casing than the length the pegs extrude outside of the casing, although in another embodiment the pegs can recede a shorter length on the inside of the casing than the pegs extrude outside of the casing, or in a further embodiment the pegs can recede a length on the inside of the casing equal to the length the pegs extrude on the outside of the casing.

The elastic material 1200 can be rubber or any other such elastic material. The rubber can be a very dense rubber or foam rubber (which is also used in gaskets), for example EDPM rubber (ethylene propylene diene monomer (M-class) rubber). In addition to rubber, latex or polyurethane could also be used, but any suitable material can be used as the elastic material which is sufficiently flexible, resistant and compressionable to serve as the elastic material as described herein.

The elastic material 1200 allows each peg to move independently from the other pegs 103. The elastic material 1200 naturally pushes each peg "out" in the direction away from the shaft. Thus, when the universal screwdriver is removed from the screw, the natural forces of the elastic material 1200 will then push all of the pegs 103 back out in the direction away from the shaft. Thus, all pegs that were depressed when the universal screwdriver was applied to the screw will naturally return to their default (extended) position when the universal screwdriver is removed (and hence no more force/pressure by the user is being applied to the pegs). Thus, FIG. 12 illustrates the default position of the pegs 103 (no pressure by the user being applied and so the pressure/force of the elastic material is pushing the pegs 103 out). Note that the more depressed a peg is into the elastic material 1200, the more pressure the elastic material 1200 would naturally push on it (because that portion of the elastic material 1200 below the respective peg is going to be more compressed). Note that if a peg is not depressed at all (e.g., it is in the default position), then the elastic material 1200 may not be applying any force at all on such peg or would be applying a small enough force that would not move the peg any further out from the default position. Each peg has an inside end which contacts the elastic material 1200 and an outside end opposite the inside end which would potentially contact a screw head (or other object) when the universal screwdriver is properly used by applying the outside end of the pegs to the screw head. When no external pressure is applied to the screwdriver (e.g., the user is not using the screwdriver to turn a screw and the screwdriver has been removed from any object such as a screw head) then the outside end of the pegs would not be contacting another object (the ends of the pegs may be contacting each other but these are not considered to be another object) and hence the natural force from the elastic material 1200 pressing against the inside end of the pegs would cause the pegs to shift to the default position (illustrated in FIG. 12). The dimensions of the elastic material can all vary depending on the embodiment.

The at least one magnet 1201 holds the 103 pegs inside the casing 102 so that when the casing 102 is turned upside down (e.g., the pegs 103 are pointed down) or laid flat on a table (e.g., the shaft is roughly parallel to the ground) none of the pegs 103 will fall out of the casing 102 due to the magnetic attraction between the pegs 103 and the at least one magnet 1201 (additional magnets can be optional). Of course, in this embodiment, the pegs 103 would have to be magnetic as well in order to be attracted to the magnet 1201. The dimensions of any of the magnet(s) can all vary depending on the embodiment.

FIG. 13A is a drawing illustrating a cross section looking in the direction of the slice marked '12' illustrated in FIG. 11 with the pegs inserted into the screw, according to an embodiment. Pressure is applied to the screw by the screwdriver and thus some (or all) of the pegs are pressed down and not in their default position.

Note that the pegs 103 are now pushed into the screw head 1202 (by the user pushing the body 100 in the direction of the screw head 1202). Note how the pegs 103 shift their position (moving in/out of the casing) in order to accommodate the screw head 1202 (e.g., in this example the recessed area of the screw head 1202). In other words, the pegs 103 "mold" themselves (using energy from the pressure applied by the user to the body 100 in the direction of the screw head 1202) to match the shape of the screw head 1202. Once the shape of the screw head 1202 is matched by the pegs 103, then the screwdriver can be turned (by the user turning the body 100) in order to turn the screw head 1202 (attached to the screw which is not pictured). Thus the configuration of the pegs in FIG. 12 will become the configuration in FIG. 13A when the pegs 103 are applied to the screw head 1202. The dimensions of the pegs can all vary based upon the embodiment, although typically all of the pegs will be the same dimensions (but not required).

When the universal screwdriver is removed from the screw head 1202, the elastic material 1200 will naturally push the pegs 103 back out to the default position (all extended) so that the pegs 103 will then be in the position illustrated in FIG. 12. Of course, any pegs that have not changed position when the pegs 103 are applied to the screw head 1202 will not need to move when the pegs 103 are removed from the screw head 1202 because these pegs are already in their default position. In other words, when no external pressure is applied to the screwdriver (i.e., the user is not pressing the pegs against another object) then the pegs would return from a depressed configuration (such as that illustrated in FIG. 13A) to the default position (illustrated in FIG. 12).

There is no limit to the number of times the apparatus can be used. When external pressure is applied to the screwdriver (e.g., the user holds the body and pressed the pegs against a screw head or other object) the pegs would move accordingly to mold to the shape of the screw head (or other object). The pegs 103 would automatically revert to the default position (all pegs fully extended) when the external pressure on the apparatus (screwdriver in this example) is removed (e.g., the pegs are not pressing against any external object such as a screw head and therefore they are subject to only the natural forces/pressure of the elastic material). From the default position, the user can then use the screwdriver to operate on (turn) an object of a different shape from the previous use (or of course it can be the same shape as well). When the screwdriver is removed from the external object, the pegs 103 would naturally assume their default position again. This process can be repeated over and over with no limit to the number of uses the apparatus can be used (and no limit to the number of different shapes that the pegs would assume to match the shape of the screw head or other object). The elastic material (e.g., rubber or other elastic material) would compress when external pressure is applied to the screwdriver/pegs (see FIG. 13A) and would automatically decompress (naturally revert to its default position) when the external pressure is removed (see FIG. 12). Portion(s) of the elastic material 1200 that are compressed would exert pressure on its respective pegs, while portion(s) of the elastic material 1200 that are not compressed would not exert pressure (or would exert very little pressure) on its respective pegs. The elastic material 1200 would be of a character such that is could be reused in the manner described herein with no limit. In other words, the elastic material 1200 would compress (when external force is applied), and then naturally revert to its natural (default position) when no external force is applied, and this cycle can be repeated an infinite number of times.

Note that the casing 102 can be any shape (e.g., circular, square, rectangular, etc.) and a recessed area inside the casing 102 wherein the pegs fit inside can be any shape (e.g., circular, square, rectangular (not square), etc.)

Figure 13B:
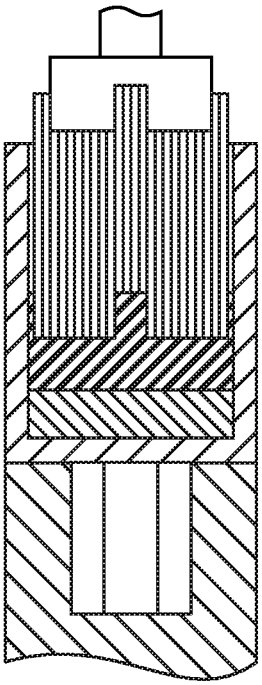
FIG. 13B is a drawing illustrating a cross section looking in the direction of the slice marked '12' illustrated in FIG. 11 with the pegs inserted into a smaller screw, according to an embodiment.

FIG. 13B is a drawing illustrating a cross section looking in the direction of the slice marked '12' illustrated in FIG. 11 with the pegs inserted into a smaller screw, according to an embodiment. Note that the screw in FIG. 13B is smaller than the screw in FIG. 13A and as such some of the pegs on the sides do not get pushed down and hence remain in their default position. Otherwise, the operation of the pegs in FIG. 13B remain the same as described with respect to FIG. 13A.

Figure 14:
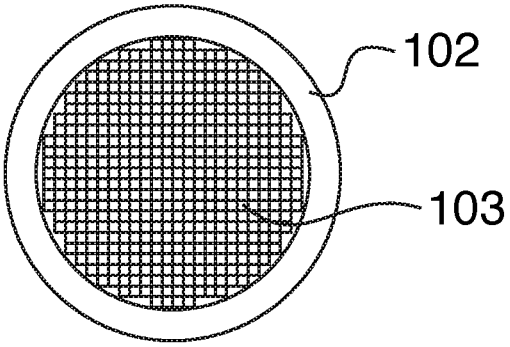
FIG. 14 is a drawing illustrating an end drawing showing an end of the pegs housed in the casing in a circular configuration, according to an embodiment.

FIG. 14 is a drawing illustrating an end drawing showing an end of the pegs housed in the casing in a circular configuration, according to an embodiment.

In this embodiment, the casing 102 is circular shaped and a recessed area inside the casing 102 is also circular shaped. All of the pegs 103 fit inside the recessed area inside the casing 102.

Figure 15:
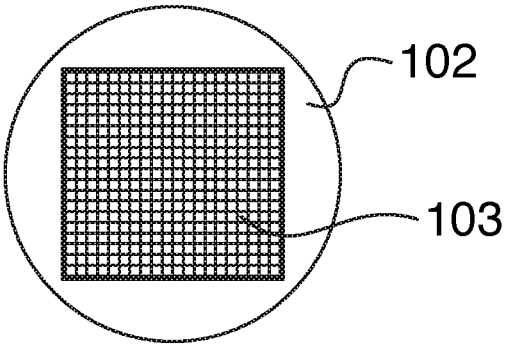
FIG. 15 is a drawing illustrating an end drawing showing an end of the pegs housed in the casing in a square configuration, according to an embodiment.

FIG. 15 is a drawing illustrating an end drawing showing an end of the pegs housed in the casing in a square configuration, according to an embodiment.

In this embodiment, the casing 102 is circular shaped and a recessed area inside the casing 102 is square shaped. All of the pegs 103 fit inside the recessed area inside the casing 102.

Figure 16:
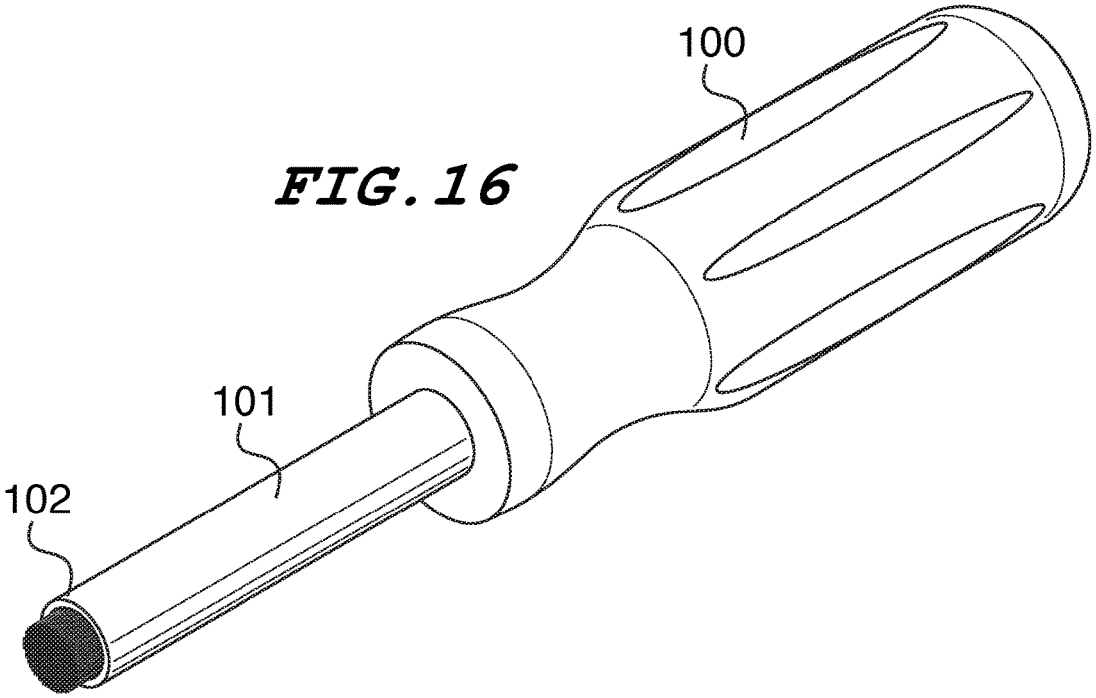
FIG. 16 is a drawing illustrating an orthographic view of a universal screwdriver with the casing integrally attached to the shaft, according to an embodiment.

FIG. 16 is a drawing illustrating an orthographic view of a universal screwdriver with the casing integrally attached to the shaft, according to an embodiment.

In this embodiment, the shaft 101 is integrally attached to the casing 102. Thus, unlike the embodiment illustrated in FIG. 1A, the casing 102 and the shaft 101 cannot be separated and reconnected by the user.

Figure 17A:
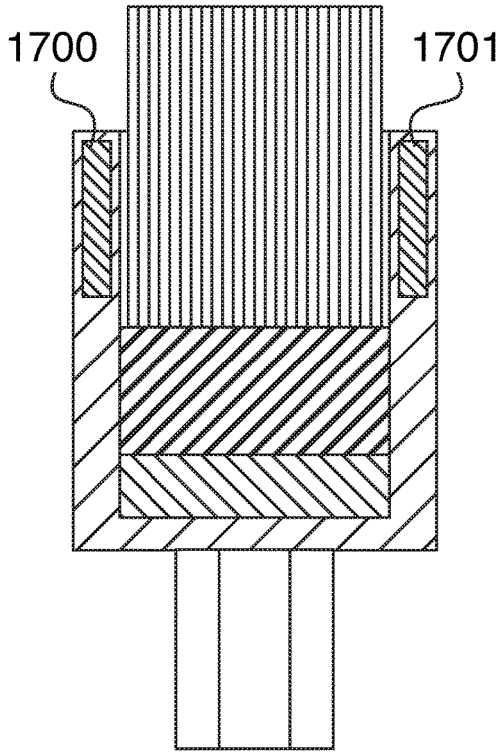
FIG. 17A is a drawing illustrating a cross section looking into the direction of the slice marked '12' illustrated in FIG. 11, with an additional magnet(s) on the side of the casing, according to an embodiment.

FIG. 17A is a drawing illustrating a cross section looking into the direction of the slice marked '12' illustrated in FIG. 11, with an additional magnet(s) on the side of the casing, according to an embodiment.

Figure 17B:
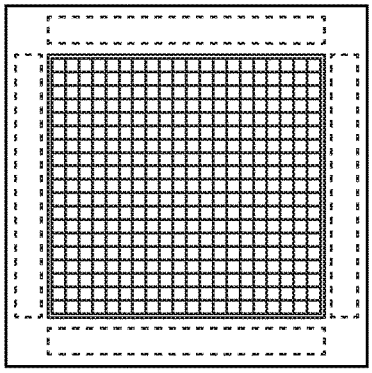
FIG. 17B is a drawing illustrating a top view of a casing configured as described herein with a square shape, according to an embodiment.

In this embodiment, the casing 102 also has a side magnet embedded inside the casing 102. FIG. 17A shows a cross section and so the side magnet is actually a single circular magnet that exists in the entire circumference of the casing 102. Note that the side magnet can be inside the casing 102, can be outside the casing 102 itself, or can be the casing 102 itself (e.g., this portion of the casing can be magnetic). In FIG. 17A, a single circular magnet is numbered as 1700 and 1701 to indicate the left side 1700 of the single circular magnet and the right side 1701 of the single circular magnet from the view of FIG. 7A. Note that instead of one continuous circular magnet in the casing, the magnet can be broken up into more than one magnet (e.g., two, three, four or more) magnets going around the circumference of the casing. Note that the magnets can be any shape (e.g., circular, cuboid, cube, etc.) Also note that the casing does not have to be circular can be any other shape, such as square, rectangular, etc. FIG. 17B shows a top view of a casing configured as described herein with a square shape, according to an embodiment.

In a further embodiment, the casing can be square or rectangular and side magnets can exist in any one, two, or three sides of the casing or all four sides of the casing. The side magnet(s) can be inside the casing 102, outside the casing 102, or can be the casing 102 itself (e.g., this portion of the casing can be magnetic).

FIG. 17B is a drawing illustrating a top view of a casing configured as described herein with a square shape, according to an embodiment.

The casing can be in any shape, in this case a square casing is shown. Note that the broken lines show side magnets (in addition to the magnet 1201) which also serve to attract the pegs to 103 to keep them from falling out of the casing. While four side magnets are shown in FIG. 17B, any number of side magnet(s) can be used in or on any combination of the side(s) of the casing (e.g., only two magnets can be used on opposite or adjacent sides, or any other configuration.)

Figure 18A:
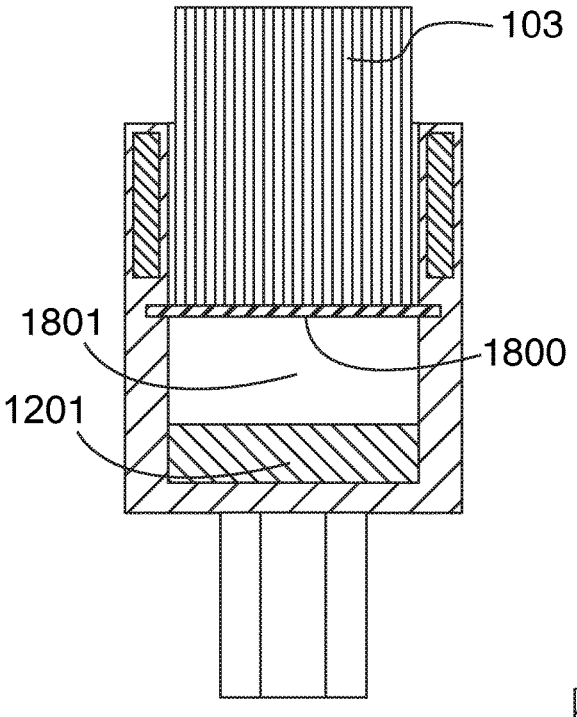
FIG. 18A is a drawing illustrating a cross section looking into the direction of the slice marked '12' illustrated in FIG. 11, with a hollow area between the elastic material and the magnet, according to an embodiment.

FIG. 18A is a drawing illustrating a cross section looking into the direction of the slice marked '12' illustrated in FIG. 11, with a hollow area between the elastic material and the magnet, according to an embodiment.

Note that a hollow area 1801 exists between the elastic material 1800 and the magnet 1201. This allows each peg that is depressed to be pushed inside the hollow area 1801 (although of course the pegs cannot pass through the elastic material 1800). When the pegs 103 are removed from the object (e.g., screw head) then the elastic material 1800 pushes the pegs back into the default position (as illustrated in FIG. 18)A. Note that the elastic material in this embodiment does not have to be compressionable.

Figure 18B:
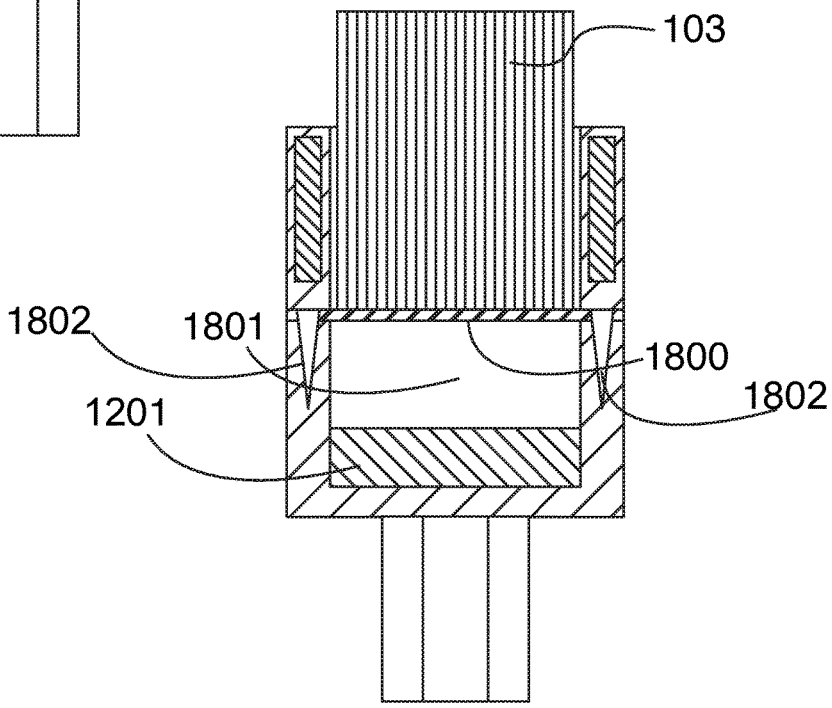
FIG. 18B is a drawing illustrating a cross section looking into the direction of the slice marked '12' illustrated in FIG. 11, with a hollow area between the elastic material and the magnet with the rubber extending from the very end of each side of the casing, according to an embodiment.

FIG. 18B is a drawing illustrating a cross section looking into the direction of the slice marked '12' illustrated in FIG. 11, with a hollow area between the elastic material and the magnet with the rubber extending from the very end of each side of the casing, according to an embodiment.

The embodiment illustrated in FIG. 18B is similar to what is illustrated in FIG. 18A but for the rubber 1800 extends through each side of the casing. In one embodiment, the extended rubber 1800 would divide the casing into an upper half of the casing and a lower half of the casing. The upper half of the casing and the lower half of the casing can be attached by spikes 1802 which are integrated into the upper half of the casing and attach into the lower half of the casing. In a further embodiment, instead of using the spikes 1803 to attach the upper half of the casing to the lower half of the casing, another attachment mechanism can be used such as an adhesive (e.g., glue between the upper half of the casing and the rubber 1800 and also between the lower half of the casing and the rubber 1800, etc.) In another embodiment, the spikes 1802 are not necessary as the casing simply has an opening for the rubber 1800 to stretch between both sides of the casing but otherwise has a solid perimeter and hence the rubber 1800 would not divide the casing into a separate upper half of the casing and a lower half of the casing which would require another attachment mechanism such as the spikes 1802.

FIG. 19A is a drawing illustrating a top view of a universal pliers, according to an embodiment. In addition to a screwdriver, any other tool that operates on an object can be adapted to operate in the manner described herein. For example, a pliers can have a two casings 1902 which operate as described herein with respect to the screwdriver. The two casings 1902 (for the pliers) are connected as illustrated in FIG. 19A and can move about a pivot point 1901 to open and close as any standard pliers would.

FIG. 19B is a cross section of the casings 1902 of the pliers shown in FIG. 19A, according to an embodiment. Shown inside the casings 1902 are the pegs 1905, elastic material 1904, and magnet 1903 which all operate as described herein with respect to the screwdriver. Any embodiments/features described herein can also be applied to the pliers embodiment.

Figure 20A:
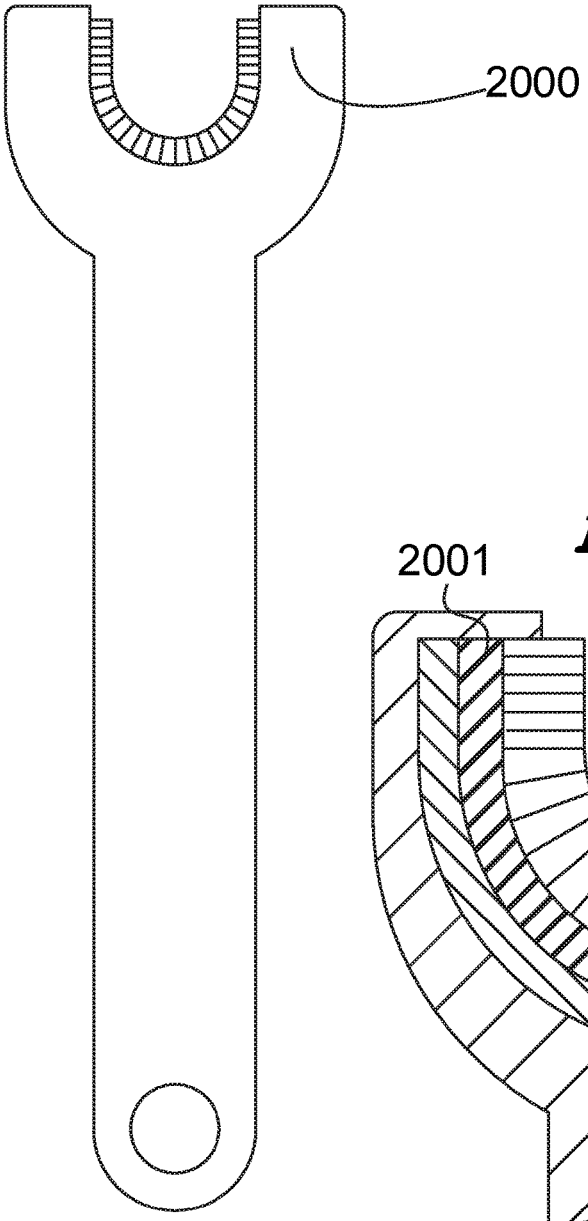
FIG. 20A is a drawing illustrating a top view of a universal wrench, according to an embodiment.

FIG. 20A is a drawing illustrating a top view of a universal wrench, according to an embodiment. A wrench can have a curved casing 2000 which operates as described herein with respect to the screwdriver.

Figure 20B:
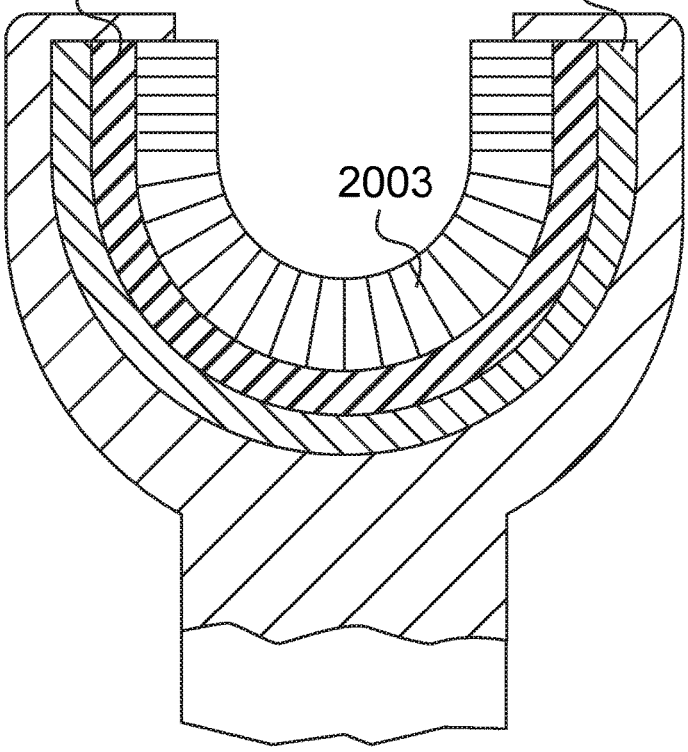
FIG. 20B is a cross section of the casing of the wrench shown in FIG. 20A, according to an embodiment.

FIG. 20B is a cross section of the casing of the wrench shown in FIG. 20A, according to an embodiment. Shown inside the casing 2000 are the pegs 2003, elastic material 2001, and magnet 2002 which all operate as described herein with respect to the screwdriver. Any embodiments/features described herein can also be applied to the pliers embodiment.

Figure 21:
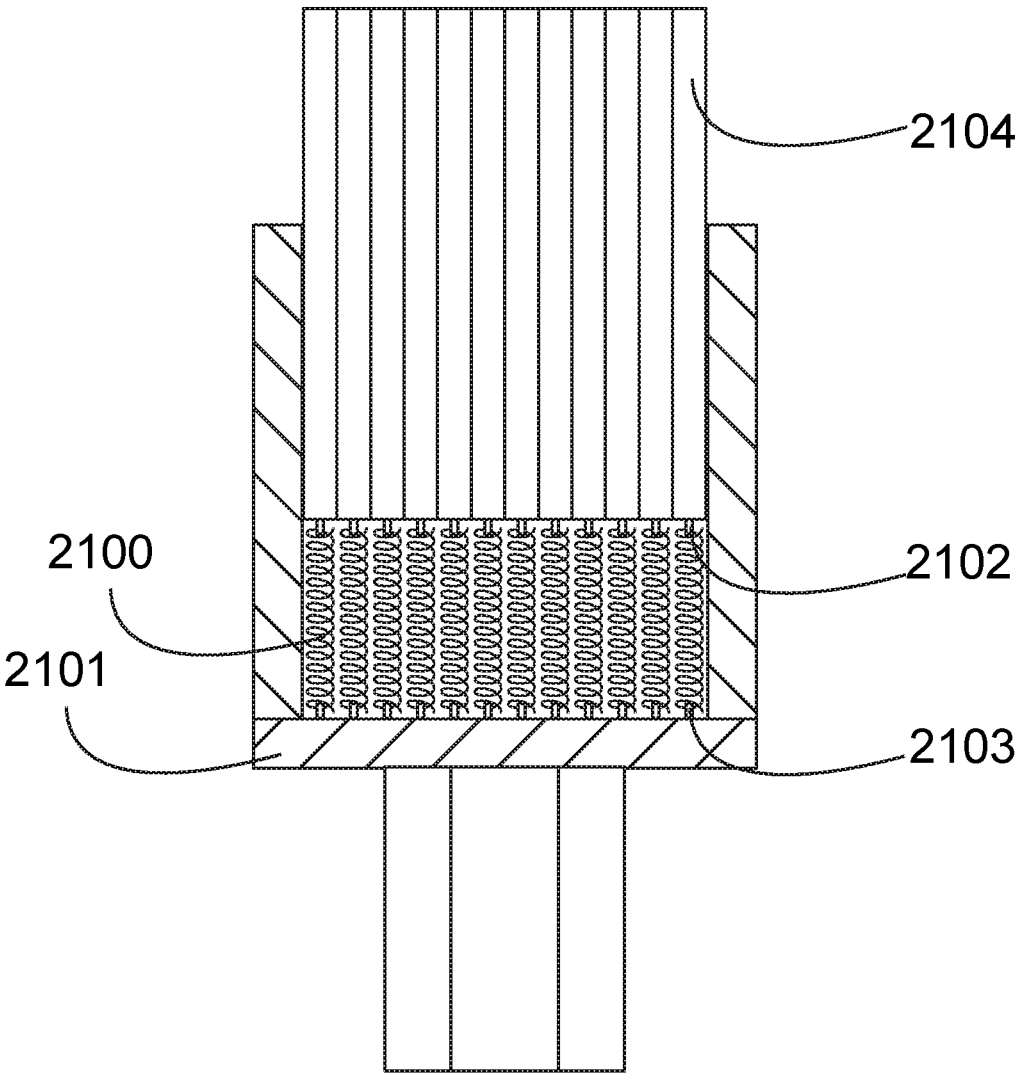
FIG. 21 is a drawing of a further embodiment utilizing springs instead of the elastic material, according to an embodiment

FIG. 21 is a drawing of a further embodiment utilizing springs instead of the elastic material, according to an embodiment.

In a further embodiment, instead of using the elastic material to push the pegs up as described herein, a set of springs 2100 can be used (typically one spring per peg). Each peg out of the pegs 2104 is attached to a respective spring which is also attached to a bottom 2101 of the casing. Each peg out of the set of pegs 2104 has a hook 2102 on the pegs' bottom to hook into a top of the pegs' respective spring. The bottom 2102 of the casing also has a set of hooks (one such hook 2103 for each spring in the set of springs 2102) which hooks onto a bottom of a respective spring.

In an optional embodiment, the top of all of the pegs have a wax or other softening agent so that the end of the pegs will not scratch a wall or paint of an object that is being operated on by the tool.

The operation of the spring embodiment is the same as described herein with respect to the elastic material, but instead of the pegs depressing into the elastic material, each pegs' respective spring will compress and then automatically expand up into its default position (thus putting its peg into the peg's default position). Thus, for example, when an object is pressed against the pegs, the set of springs compress which will allow the pegs coming into contact with the object to depress (compress) thereby lowering the respective peg(s) thereby allowing the pegs to mold themselves to fit the shape of the object being operated on. When the object is removed (no external pressure being placed upon the object), then the springs will naturally push the pegs back into their default positions. For example, see FIGS. 1A, 1B, 2, 3A, 3B, 4A, 4B, 5-12, 13A, 13B, 14, 15, 16, 17A, 17B, 19A, 19B, 20A, 20B which all can be applied to the spring embodiment. In other words, simply replace the elastic material with the set of springs as described herein (and the magnets would no longer be necessary). Thus, the description of the embodiments described herein can also be applied to the spring embodiment (except of course excluding matter regarding the elastic material which is replaced by the set of springs 2100 which refers to all of the springs). Of course, if the grid comprises 10×10 (100) pegs, then there will necessary be 10×10 (100) springs to operate on all of the pegs. As in the elastic embodiment, this spring embodiment is also reusable so that different shaped objects can be operated on, as each time an object is removed from the pegs the springs push the pegs back into their default position. Like the previous embodiments, each peg is independently movable. In this embodiment, magnets would not be necessary because each spring would be permanently attached to the bottom 2101 and then to a bottom of its respective peg. Thus, the pegs would not be able to fall out.

All components described herein can be made from any suitable materials. With the exception of the elastic material, all other components can be made of any combination of any suitable materials such as steel, aluminum, hard plastic, any metal, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:

a casing comprising a hollow area;

a magnet located inside the casing;

an elastic material located inside the casing over the magnet;

a hollow area between the elastic material and the magnet; and a plurality of pegs located over the elastic material, the plurality of pegs each configured to individually move between a fully extended position and a depressed position, wherein the plurality of pegs are magnetic and the magnet and the plurality of pegs are configured such that magnetic attraction between the magnet and the plurality of pegs urge the plurality of pegs to not fall out of the casing.

2. The apparatus as recited in claim 1, wherein the elastic material is structured to naturally push the plurality of pegs into the fully extended position when no external pressure is applied to the apparatus.

3. The apparatus as recited in claim 1, further comprising a shaft which is attached to the casing.

4. The apparatus as recited in claim 3, wherein the shaft is removably attached to the casing.

5. The apparatus as recited in claim 3, wherein the shaft is permanently attached to the casing.

6. The apparatus as recited in claim 3, wherein the shaft is attached to a body.

7. The apparatus as recited in claim 6, wherein the elastic material is structured to naturally push the plurality of pegs into the fully extended position when no external pressure is applied to the apparatus.

8. The apparatus as recited in claim 1, wherein the casing is circular.

9. The apparatus as recited in claim 1, wherein the casing is rectangular or square.

10. The apparatus as recited in claim 1, further comprising at least one additional magnet(s) on or in at least one side of the casing.

11. An apparatus, comprising:

a casing comprising a hollow area;

a magnet located inside the casing;

an elastic material located inside the casing over the magnet;

a hollow area between the elastic material and the magnet; and a plurality of pegs located over the elastic material, the plurality of pegs each configured to individually move between a fully extended position and a depressed position;

wherein the elastic material is structured to naturally push the plurality of pegs into the fully extended position when no external pressure is applied to the apparatus, wherein the plurality of pegs are magnetic and the magnet and the plurality of pegs are configured such that magnetic attraction between the magnet and the plurality of pegs urge the plurality of pegs to not fall out of the casing.

12. The apparatus as recited in claim 11, further comprising a shaft which is attached to the casing.

13. The apparatus as recited in claim 12, wherein the shaft is removably attached to the casing.

14. The apparatus as recited in claim 12, wherein the shaft is permanently attached to the casing.

15. The apparatus as recited in claim 12, wherein the shaft is attached to a body.

16. The apparatus as recited in claim 11, wherein the casing is circular.

17. The apparatus as recited in claim 11, wherein the casing is rectangular or square.

18. The apparatus as recited in claim 11, further comprising at least one magnet(s) on or in at least one side of the casing.

* * * * *